United States Patent [19]

Reil et al.

[11] Patent Number: 5,069,021

[45] Date of Patent: Dec. 3, 1991

[54] APPARATUS FOR PRODUCING A FLUIDS PACKAGE

[75] Inventors: Wilhelm Reil, Bensheim; Ulrich Deutschbein, Muhltal; Udo Liebram, Pfungstadt, all of Fed. Rep. of Germany

[73] Assignee: Tetra Pak Holding & Finance S.A., Pully, Fed. Rep. of Germany

[21] Appl. No.: 559,898

[22] Filed: Jul. 30, 1990

[30] Foreign Application Priority Data

Aug. 17, 1989 [DE] Fed. Rep. of Germany ..... 3927199

[51] Int. Cl.[5] ..... B65B 3/02

[52] U.S. Cl. ..... 53/563; 53/202; 53/561; 493/85; 493/164

[58] Field of Search ..... 53/563, 456, 452, 561, 53/202, 423, 272; 493/165, 164, 105, 102, 85, 87, 338

[56] References Cited

U.S. PATENT DOCUMENTS

| | | | |
|---|---|---|---|
| 2,697,313 | 12/1954 | Wilcox . | |
| 4,204,382 | 5/1980 | Guyonnet | 53/563 |
| 4,217,745 | 8/1980 | Watzka | 53/202 X |
| 4,566,251 | 1/1986 | Spisak et al. | 53/202 X |
| 4,604,850 | 8/1986 | Reil | 53/563 X |
| 4,790,123 | 12/1988 | Ljungstrom et al. | 53/202 X |

FOREIGN PATENT DOCUMENTS

| | | |
|---|---|---|
| 0155984 | 10/1985 | European Pat. Off. . |
| 2114048 | 10/1972 | Fed. Rep. of Germany . |
| 2705596 | 8/1978 | Fed. Rep. of Germany . |
| 3315487 | 10/1984 | Fed. Rep. of Germany . |
| 3531728 | 3/1986 | Fed. Rep. of Germany . |
| 3531663 | 3/1987 | Fed. Rep. of Germany . |
| 407860 | 9/1960 | Switzerland . |
| 1050816 | 8/1963 | United Kingdom . |

OTHER PUBLICATIONS

German Patent Application GM7430127, Zumstein et al, "An Apparatus for Manufacturing Tubular Cartons", 9/7/74.

*Primary Examiner*—James F. Coan

*Attorney, Agent, or Firm*—Paul & Paul

[57] ABSTRACT

The invention describes an apparatus for producing a fluids package, with a synthetic plastics coated paper tube, of which one end is closed by an injected synthetic plastics lid while its other end is closed by holding and welding the tube material, with a device (8) for forming a tube from a web (2), at least one intermittently rotatable mandrel wheel (27), an injection station (29), an endless conveyor (31) for the packages (34) during the course of their production, a filling station (63), a closing station (62) and with a removal conveyor (39).

To increase the machine output and to permit simplification of some of the handling units, it is according to the invention envisaged that at least two mandrel wheels (27) should be disposed one beside the other to rotate about a common axis (43) and in front of which, viewed in the direction of movement (20) of the relevant paper tube, there is a folding device (8) and in front of that web distributing station (25) and behind which (27) there is the at least two-track endless conveyor (31) which has for the packages (34) receiving containers (30) which are adapted to be brought into positions which are in a rectilinear extension of the relevant package path (20), the receiving containers (30) revolving on the lower strand (35).

10 Claims, 5 Drawing Sheets

APPARATUS FOR PRODUCING A FLUIDS PACKAGE

The invention relates to an apparatus for producing a fluids package with a synthetic plastics coated paper tube, of which one end is at least partially closed by injection moulded parts of synthetic plastics material, the other end being closed by folding and welding the tube material, with an arrangement for forming a tube from a web, at least one intermittently rotatable mandrel wheel, an injection station, an endless conveyor for the packages during their manufacture, a filling station, a closing station and with a removal conveyor.

Packages of the above-described type for holding fluids are known in which the lid consists of synthetic plastics with no carrier material and is injection moulded onto the paper tube while the bottom is closed by transverse welding of the tube (after filling and folding over) and fastening. Also known is a machine for producing such a package which comprises a dividing machine for producing the tube, an injection unit with a mandrel wheel and an endless conveyor, along the path of which the package, closed at one end, is filled and then closed.

Such a package producing machine is very expensive, even taking the injection unit into account, and the synchronous control between the tube producing machine, the injection machine and the endless conveyor.

Nevertheless, machine and also package producers are constantly seeking to increase the output of the manufacturing machines without excessively forcing up the cost of the machine technology, although, of course, it is still as important to guarantee sealing-tightness and the other advantages of the completed package as in the past. If, then, one end of the package is at least partially or—as in the case of the abovedescribed prior art fluids package—completely by an injection moulded part, the injection device takes a certain time to complete the injection moulding of this one end of the tube in a perfectly tight and preferably fluid-tight manner with the necessary hardening-off and cooling time for the subsequent mechanical loading.

Only a low rate of output was possible with the prior art machines with injection moulding equipment, on account of the relatively long time it took for the moulding to cool. By reason of the long cooling times, the manufacturer and the user of such package producing machines were tied to long cycle times, for instance over two seconds in the case of really large machines.

Therefore, the invention is based on the problem of so improving the manufacturing apparatus of the type mentioned at the outset that in spite of the necessary cooling times the output of the machine can be increased, simplification of some of the machining steps and units being nevertheless possible.

According to the invention, this problem is resolved in that at least two mandrel wheels are disposed to rotate beside each other about a common axis, in front of which, viewed against the direction of movement of the relevant paper tube, there are a folding device and, in front of that, a web distributing station and behind which there is at the at least two-track endless conveyor which comprises containers adapted to receive the packages which rung along on the bottom strand, the said containers being adapted to be moved into positions disposed in a rectilinear extension of the relevant package path. To increase the output of a package producing machine, it is indeed indicated to use a plurality of mandrel wheels parallel with and beside one another instead of a single mandrel wheel but the use of a plurality of mandrel wheels will be recognised by a man skilled in the art as entailing also a plurality of supply rolls from which, according to the number of mandrel wheels, a plurality of paper webs will be pulled off parallel with one another. According to a first feature of the invention, however, working entails only one supply roll and thus only one web is used, a web distributing station ensuring that a plurality—initially the preferably two mandrel wheels mentioned—are each supplied with a flat blank. According to a further feature of the invention, this blank which, prior to or upon the web entering the web distributing station, is separated from the web, viewed in the direction of movement of the blank or paper tube, and is fed into a folding device in which the blank is folded out of its flat state and into the form of a sleeve or tube in which form it is fixed, the tube only then arriving on the relevant mandrel of a mandrel wheel, the longitudinal direction of this mandrel lying in a rectilinear extension of the direction of movement of the blank and of what will later be the tube, downstream of the web distribution station. In the region of the mandrel wheels, the tubes or sleeves are in per se known manner provided at one open end with synthetic plastics injection moulded parts so that the paper tube in question is closed at this end and it is by this closed end which is in front in the direction of movement, that the paper tube is removed from the relevant mandrel wheel and moved into the receiving position of the endless conveyor which is to be described hereinafter. Here, too, it is advantageous for the relevant receiving container on the endless conveyor to be brought into a receiving position which is so disposed that the paper tube which is moulded closed at one end can be moved directly onto the endless conveyor in a rectilinear extension of the mandrel wheel. Finally, it is furthermore advantageous if, in the region of the endless conveyor, the paper tube can be aligned in a suitable position, i.e. with the open end pointing upwardly, the tube being filled in this position and the package then being completely closed by transverse sealing. A removal conveyor then takes the finished and filled packages from the removal conveyor and passes them on to further handling stations, e.g. a station where a plurality of packages are bundled into a multiple package by shrinking or the like.

As a result of the measures according to the invention, there is for each paper tube sufficient time (including cooling time) for partial closure of one end with injection moulded parts. At the same time, the output of the machine is not inconsiderably increased, and nevertheless the skilful configuration and disposition of the individual handling units reduce the amount of space required for the machine as a whole. In contrast to hitherto known machines, in fact, here the blanks and the tubes which are formed from them are conveyed in one rectilinear plane until they enter the endless conveyor where handling takes place in two planes and at the same time the packages are turned over into their final desired position. When the direction of movement of the removal conveyor extends in the direction of the axes of the mandrel wheels or the axes of the direction reversing wheels of the endless conveyor, the length of the machine can be reduced considerably.

The design and surprisingly expedient correlation of the individual component units to one another makes it possible in a further advantageous manner to achieve rapid and optimum production of the package, particularly since no unnecessary embossing lines have to be provided in the paper tube. For example, there are package producing machines in which, while it is being produced, the tube is from time to time laid flat and in the case of round or partially round tube forms, there are then two superfluous embossing lines which are dispensed with by the invention. In other words, the package is according to the invention removed from the roll and then taken from the flat blank, is machined and produced and right from the first fold, namely in the above-mentioned folding device, the final shape of the paper tube is produced so that unnecessary intermediate steps which were only required by manufacture, become unnecessary according to the invention.

According to the invention, it is furthermore expedient if the web of the relevant paper tube, upon transfer from one station of the apparatus to the next, lies in a horizontal straight line from the folding device as far as the receiving position of the endless conveyor. If there are a plurality of webs, and in the present case at least two have been mentioned and one embodiment clearly shows three handling lines, there is a straight plane which extends from the web distribution station as far as the receiving position of the endless conveyor. Also in the region of the endless conveyor, this handling path does not really change, because it is just divided into an upper strand and a lower strand, so that processing can take place in both strands, although both strands are parallel with the aforesaid horizontal straight plane; the upper strand is offset upwardly and the bottom strand downwardly by the radius of the direction reversing wheel.

It is further conducive to solution of the problem according to the invention if, in a further development of the invention, the longitudinal direction of the receiving container which is horizontal in the receiving position becomes vertical in the delivery position. This means that the paper tube is conveyed in the aforesaid horizontal plane in a straight line until it reaches the receiving .position of the endless conveyor, in a direction which is parallel with the longitudinal direction of the receiving container in the receiving position. It has been mentioned above that the receiving containers on the endless conveyor revolve with it—rather like a chain—and if the longitudinal direction of the receiving container is horizontal in the receiving position, then for the following reasons, it is expedient for its longitudinal direction in the delivery position to be vertical in relation to the removal conveyor. Then, in fact, there is a rotation through 90 and preferably 270° and this rotation is used at the same time as a turning station. It will also be explained hereinafter why the final handling of the transversely sealed bottom is expediently carried out in a position in which the bottom is at the bottom and the lid is at the top, i.e. the longitudinal direction of the filled package is substantially vertical. This very position is, however, attained by turning the package in the endless conveyor when the longitudinal direction of the receiving containers is altered from horizontal to vertical in the manner described in accordance with the invention According to the invention, it is also advantageous if the filling station and closing station are disposed in the region of the endless conveyor, alongside and in functional communication with this latter. Consequently, the manufacturing machine can be substantially shortened, particularly if the final handling of the transversely sealed bottom of the package is carried out in the region of the curved transition from the upper strand to the lower strand and to a certain extent still in the region of the lower strand A further shortening of the machine can be achieved if, according to the invention, the removal direction of the removal conveyor lies parallel with the common axis of the mandrel wheels, at least in the region of the endless conveyor. Then, in fact, the completely closed package can be removed from the endless conveyor, from the aboveddescribed vertical delivery position and is passed to other handling equipment.

The described folding device which produces the finished sleeve or paper tube from the flat blank, in a further advantageous development of the invention, comprises rollers mounted on movably driven arms, a bracing mandrel and a movable welding die which are disposed beside one another and which are disposed to be brought into engagement with one another. If a connecting line is drawn through the longitudinal central line of these three parts, i.e. the bearing of the arms, the rollers, the bracing mandrel and the movable welding die, then it is expedient for the connecting line to be at right-angles to the straight plane, which is preferably horizontal, so that the connecting line is preferably vertical. The bracing mandrel is expediently at such a height that the flat blank delivered comes to rest on the upper surface of the of the bracing mandrel, in fact below the arms and the rollers. If, then, the arms are operated in the appropriate sequence, as will be described in greater detail hereinafter, then the blank can be rolled around the bracing mandrel and brought to the longitudinal sealing stage on that side of the bracing mandrel which is opposite the arms. This is the side where the welding die is movably disposed. Ideally, in order to make the longitudinal sealing seam, it moves along the underside of the bracing mandrel, seals the edges of the previously flat and now tube-shaped blank, and then moves again into the starting position at a distance from the bracing mandrel.

According to the invention, it is furthermore expedient if there is in the endless conveyor at least one row of receiving containers comprising at least one recess for a package and revolving in the form of an endless chain, the containers being supported to be driven in the straight strand in such a way that they touch one another and in that in a rectilinear extension of the package path there are driving wheels and/or direction reversing wheels disposed one after another at intervals. Viewed from the side, at least two or a plurality of receiving containers are disposed behind one another or one receiving container is provided with a plurality of recesses which are disposed one behind another. In the direction of movement of the endless conveyor, one receiving container is disposed alongside the other, so that they form a row and revolve like an endless chain. In whichever happens to be the straight upper and lower strand, the receiving containers touch one another so that they push one another without any restriction. Therefore, it will be sufficient for the respective receiving container in the region of the driving and/or direction changing wheel, to be in engagement with the endless conveyor element and to be driven while in the region of the straight strand the drive is carried out by the pushing action of the receiving container which is the nearest behind it. This achieves an exact positioning and a precise speed.

Furthermore, it is advantageous if each driving and direction reversing wheels comprises radial arms with, disposed at the outer ends, slots for the separable engagement of journals on the receiving containers. As a result of this construction, the receiving container in question can actually be guided, moved and driven in the curved portions of the endless conveyor by the driving and direction reversing wheels, while in the other parts, the receiving container becomes disengaged from such drive elements as are connected to the endless conveyor element, such as, for example, the radial arms on the wheels, or a chain, which connects the two wheels additionally to the receiving containers. By reason of the slots into which the journals can engage and from which they can be disengaged, the establishment of engagement and disengagement can be evenly and precisely performed.

If, furthermore according to the invention, an adjustable bottom support is fixed on each recess in the receiving container, e.g. a support in the form of an L-shaped bar or the like, which is mounted for displacement in the longitudinal direction of the paper sleeve which is to be received, then paper tubes of different lengths can be introduced and maintained at an exact height along the track of the endless conveyor. For example, a receiving container may comprise an elongated plate extending from one end over the entire width of the endless conveyor to the other end and may have at right-angles to its extension recesses for insertion of paper tubes. From this plate, in the region of whichever is the straight strand of the endless conveyor, guide rods may extend at the edge of the recesses and over the length of the paper tube which is to be supported. The tube is pushed into the recess and is guided by the rods so that it is held firmly with a slightly clamping action in the desired position.

In the region of the endless conveyor, the package can preferably be filled in the region of the upper strand and provided with a transverse seal. In this condition, then, triangular double-layer material tabs extend outwardly from the transversely sealed bottom (in the direction of the transverse sealing seam), and these have to be folded over. For this purpose, tube corner folding and fastening means are provided preferably in the region of the direction changing wheel and thus in the region of the curved part of the endless conveyor. In these areas, the corners of the tube in question are folded over lengthwise of the path of movement of the endless conveyor, and are subjected to pressure in the subsequent zone and at another further station they are fastened by heating means. Subsequently, the finished tube is passed on to the removal conveyor.

In a preferred embodiment, the receiving container which is in the receiving position has a paper tube pushed into it and is moved through 90° and upwardly into the vertical so that the open end of the paper tube is pointing upwards, generally away from the endless conveyor. In this state, the tube is, in a further station along the intermittently propelled endless conveyor, lifted so that the tube can be filled with contents. According to the filling level, so the paper tube is lowered again and after completion of the filling process, the endless conveyor is shifted on to the next position. Preferably, it is only in the next position but one that transverse sealing of the bottom takes place. On the then not quite completed folded bottom, therefore, the above-described corners project outwardly. On the curved path of the transverse sealing seam from the upper strand to the lower strand, the projecting corners are raised through 90° while the longitudinal axis of the paper tube has pivoted through 180° during the movement of the direction reversing wheel. Then the transverse sealing seam of the bottom fastening has cooled sufficiently and has hardened to the point that it can accept a mechanical loading. The contents are then, in fact, situated above the transverse sealing seam. By the rotation of the package through 180° from the upper strand to the lower strand, the contents will drop onto the folded bottom where, now, the triangular lugs created by folding are applied by pressure against the bottom and are sealed by heat in the next station. This sealing heat and also heat still available from transverse sealing in the sealing station can be accommodated by the material being packaged, which is a particular advantage, because the contents are no longer at a distance from the folded bottom (as in the region of the upper strand) but are directly in contact with the folded bottom due to the fact that the package has been turned over (as in the region of the bottom strand). Thus, it is advantageously possible further to shorten the cooling times. The contents themselves can therefore to a certain extent be used as a cooling medium A man skilled in the art will immediately see that by virtue of this measure according to the invention, a heavy duty machine can be improved with simple working units and with a high level of output.

It is furthermore expedient according to the invention to provide a cooling device between the injection station and the endless conveyor on the path of conveyance of the lid which is injection moulded onto the paper tube. Also this measure serves for better cooling and for increasing the machine output. Preferably, the cooling arrangement comprises jets for expelled cooling air. These jets are preferably evenly distributed over the entire quarter-circular path from the injection station to the receiving position on the mandrel wheel and they play on the freshly injected lid or the cast parts injection moulded in the lid region, so that they are adequately cooled and hardened when the paper tube, closed at one end, is pushed out from the mandrel wheel and finds its way into the receiving container.

The package producing machine can be so constructed that all the drive units dare disposed on that side of the machine which is at the rear in relation to someone looking at the machine. These drives which are disposed at the back of the machine favour operation and maintenance by staff because the motors are no hindrance.

Further advantages, features and possible applications of the present invention will emerge from the following description of a preferred example of embodiment, which should be taken in conjunction with the accompanying drawings, in which.

Figure 3:
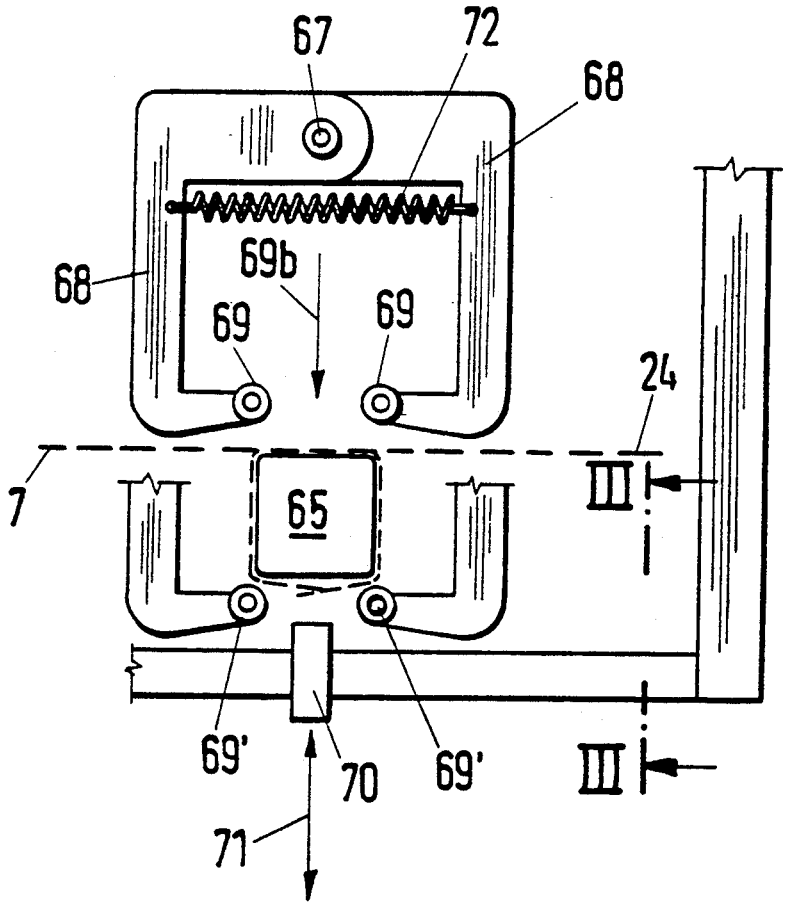
Figure 3A:
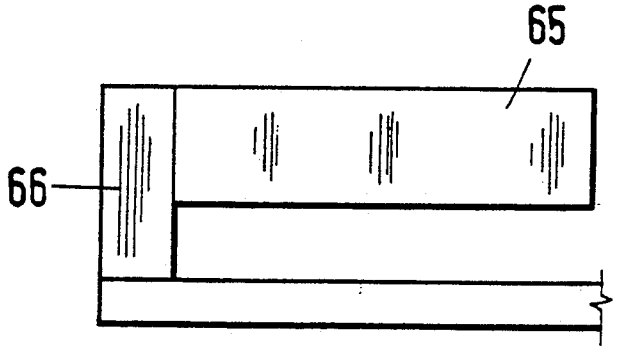
Figure 4:
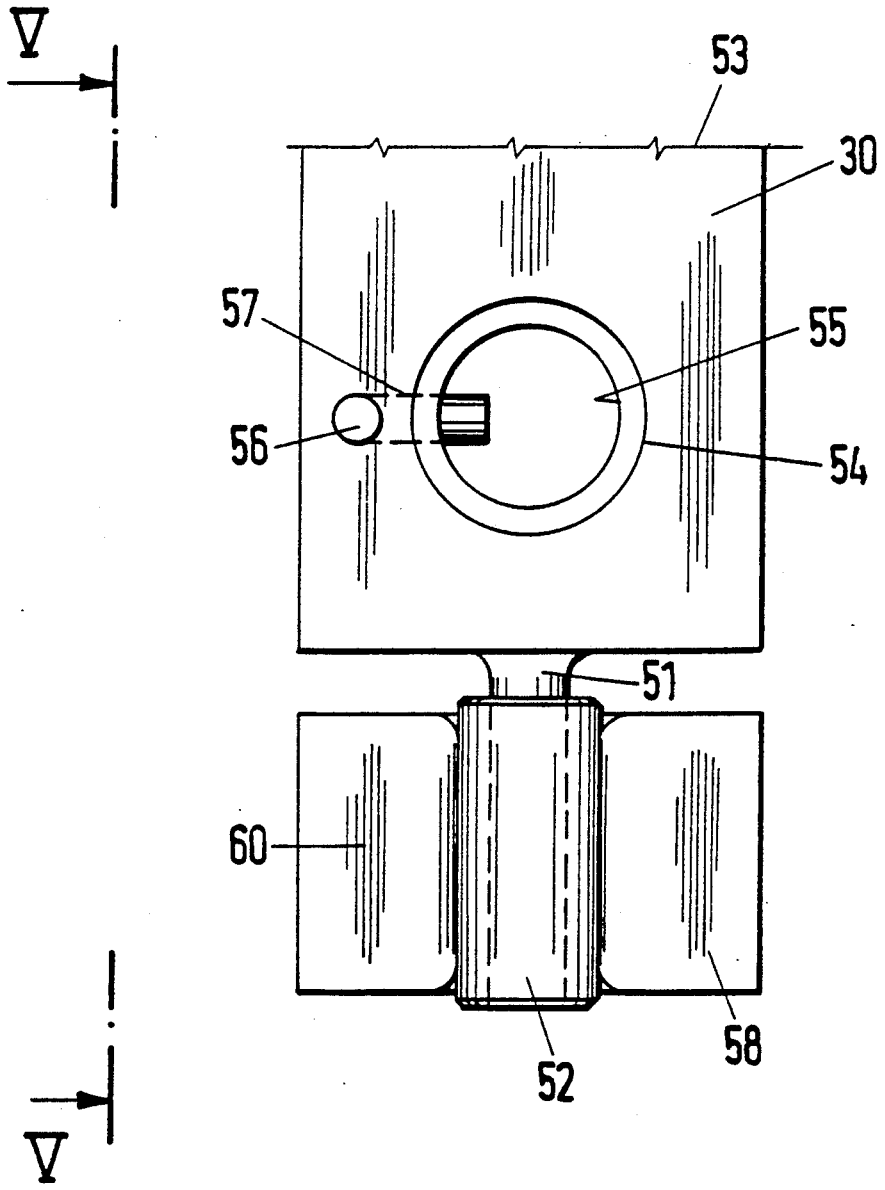
Figure 5:
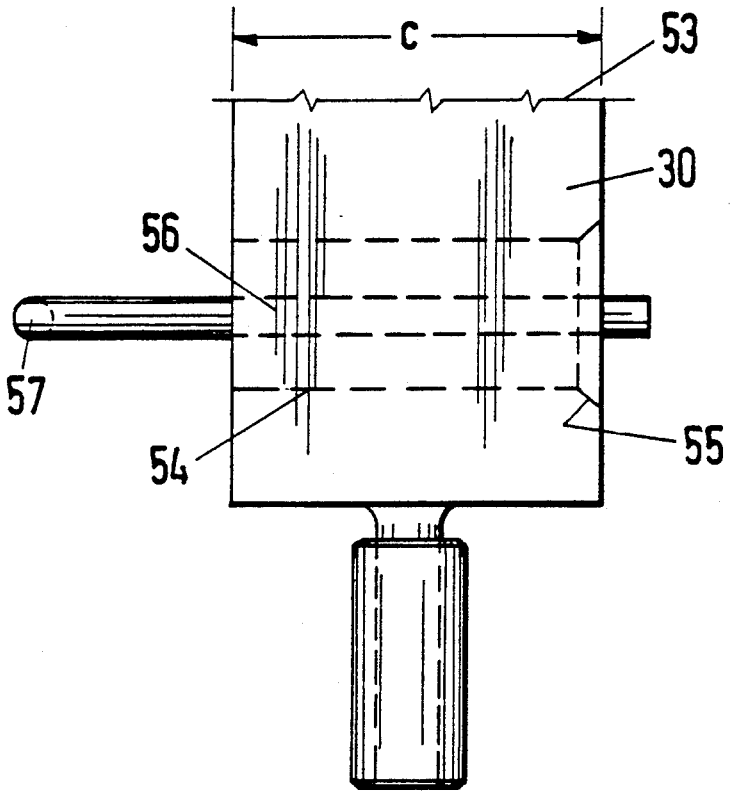
Figure 6:
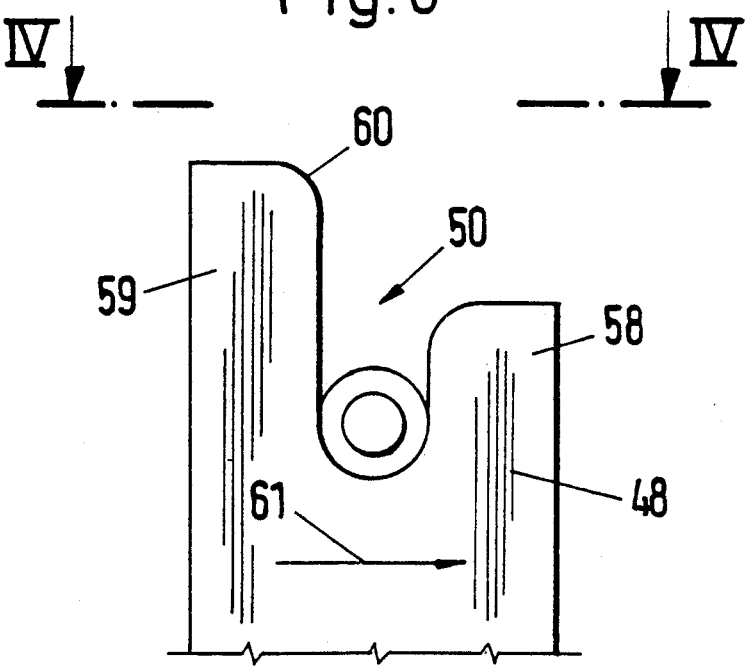

FIG. 3 diagrammatically shows the folding device when looking in the direction of the moving blanks or paper tubes;

FIG. 3*a*, is a diagrammatic view along the arrow III—III in FIG. 3, only the bracing mandrel and its support being shown;

FIG. 4 is a plan view of a receiving container, of which the top has been broken away, with laterally projecting journals and a roller located in the drive arm;

FIG. 5 is a side view of the receiving container taken on the line V—V in FIG. 4, and FIG. 6 shows in a broken away and enlarged view a detail of a driver arm with a slot which in plan view, on the line IV—IV, looks as indicated at the bottom of FIG. 4.

Figure 1:
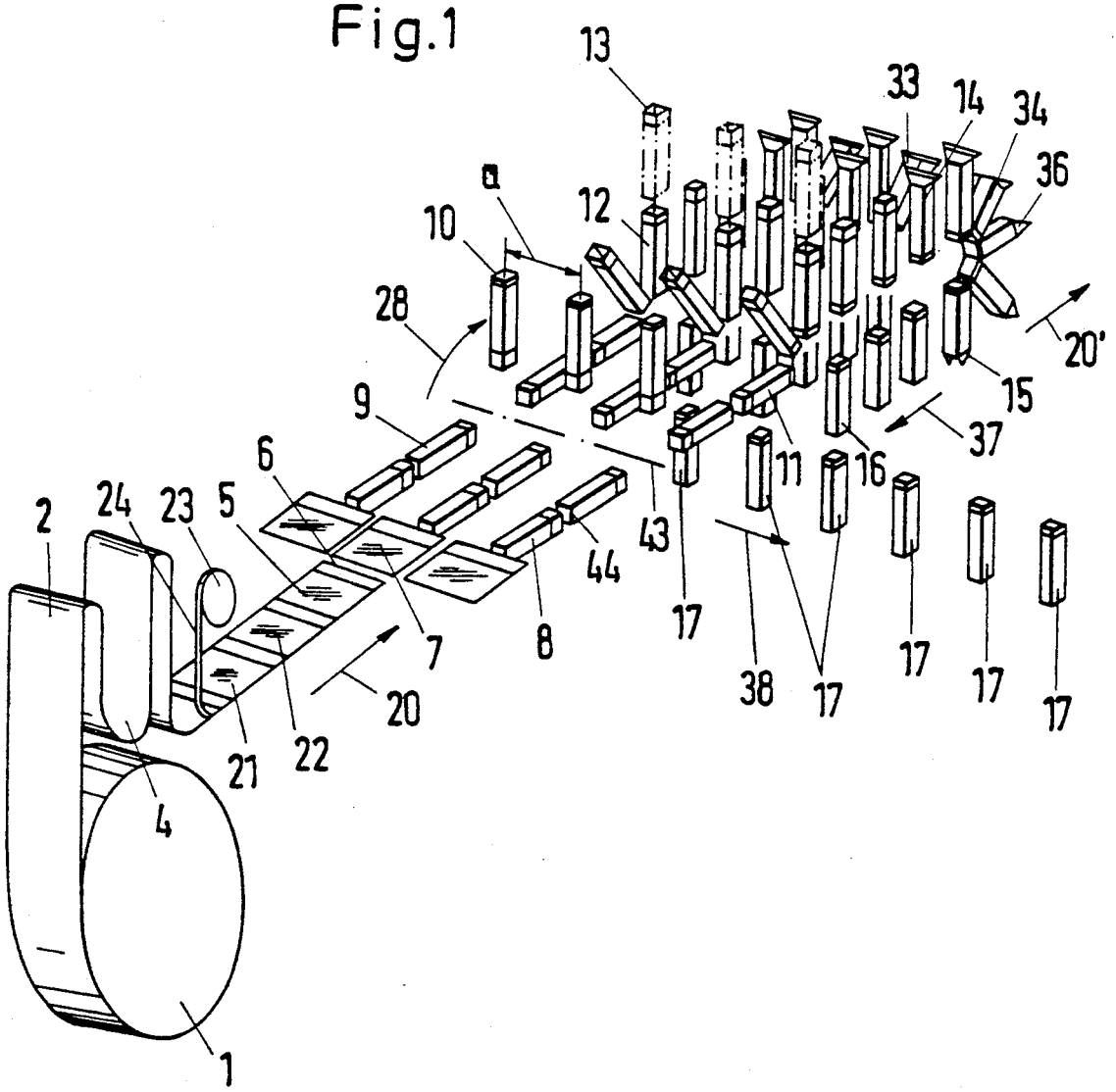
FIG. 1 is a diagrammatic perspective view of the synthetic plastics coated web of paper from which the relevant paper tube is formed, shaped into a package and is finally discharged.

The package manufacturing apparatus can best be explained with reference to FIGS. 1 and 2, reference being initially made mainly to FIG. 1, the formation of the paper tube and then of the finished package being initially described without any of the mechanical elements. Some parts of the web, the flat blank and some stations of the paper tube or package can also be seen in FIG. 2 with the same reference numerals as explained hereinafter with reference to FIG. 1, initially for general appreciation of the invention. It should be borne in mind in this respect that distribution of one web over three webs applies to the preferred embodiment described here. If required, also a plurality of handling paths can be provided.

A web 2 of paper coated on both surfaces with synthetic plastics material is pulled from a supply roll 1 and is passed over a first direction changing roller 3 to a downwardly suspended buffer loop 4, the outlet end of which is defined by a second upper direction reversing roller 4*a* over which the web of paper 2 is passed and is then guided vertically downwardly to a bottom direction reversing roller 4*b* whence the paper web 2 attains an imaginary general machining plane which is straight and horizontal. In this handling plane which according to FIG. 2 is at right-angles to the plane of the paper although according to FIG. 1 it coincides with the plane of the paper web 2, the paper web 2 is now moved in the direction 20 and, in the first zone 21 and possibly also in the subsequent zone 22, embossing lines corresponding to the individual blanks are incorporated into the paper web until this latter reaches the position 5.

Also for edge protection, care is taken to see that one synthetic plastics strip 24 is withdrawn from a supply roller 23 and becomes settled on the edge of the moving paper web 2, substantially in the region 21.

The buffer loop 4 of the paper web 2 allows the supply roll 1 to rotate continuously if, for example, the first direction reversing roller 3 provides for continuous draw-off of web 2 from the roll 1 while in the region 5, the paper web performs an intermittent movement.

This intermittent movement of the paper web 2 in the direction of movement 20 is necessary for numerous machining stages, for example for carrying out the isolating cut at 6, by which the individual blanks 7 are produced from the paper web 2. At the onset of manufacture, even, the cut-away first blank 7 is pushed by a web distribution station shown in FIG. 2 and generally designated 25 out of the middle position and leftwardly, after which the next blank is pushed out of the middle position and rightwardly, whereupon the third blank then remains in the position shown in the centre of FIG. 1, at 7. Therefore, whereas the paper web 2 has been displaced through three positions in the direction of movement 20, there is no movement in the direction 20 in the subsequently selected positions. The three blanks 7 which are adjacently disposed in the preferred embodiment shown here are then conveyed to the folding device, generally designated 8, where the paper tube 9 is completed by being folded over and longitudinally sealed. This paper tube 9 is open at both ends and upon the next forwards-shifting movement, it is pushed onto the horizontal mandrel 20 of the mandrel wheel generally designated 27. After forwards rotation of the mandrel wheel in the direction of the arrow 28, the relevant paper tube 9 is then in a vertical position, i.e. the longitudinal direction of the paper tube has been rotated through 90° out of the handling plane described above and into the vertical The lid 10 is injection moulded onto the lid end of the paper tube 9 by the injection station generally designated 29 and shown in FIG. 2. At the next onwards shift of the relevant mandrel wheel 27, the paper tube 9 which is now closed at the lid end is moved into the receiving position 10 in the receiving container 30 of an endless conveyor generally designated 31, on which the paper tube 9, closed at one end, is so rotated in the same direction (as the direction of rotation 28 of the mandrel wheels 27) and onto the vertical that its open bottom end is positioned at the top. From here, the empty paper tube is raised into the position 13 shown by dash-dotted lines, is filled and is then lowered back into the position 12 again, according to the degree of filling.

Here, then, open at one end and filled, the paper tube 9 is moved onwards intermittently from the start of the upper strand 32 of the endless conveyor 31, being moved in the direction of travel 20′, parallel with the direction 20 and above the handling plane If, for example, milk is filled into the container in the position 13, then it is expedient to incorporate two positions with no handling process, until the paper tube 9 has reached the position 14 in which the transverse sealing seam 33 is made. During onwards conveyance of the now closed and filled package which is therefore designated 34, it passes firstly along a curved path between the upper strand 32 and the lower strand 35 which follows it, the double-walled triangular tabs 26 projecting laterally through the transverse sealing are so folded over that in the position 15 they finally project downwardly in the longitudinal direction of the package 34. Upon onwards conveyance in the direction of the arrow 37, these triangular tabs 36 are folded over, fastened to the flat bottom and in this position 16 the fluids package is then finally completed.

From the endless conveyor 31, they are withdrawn vertically downwardly to position 17 and are carried away in the direction of the arrow 38 at right-angles to the direction of movement of the lower strand 35 according to the arrow 37.

In the case of the aforementioned handling path from the paper web 2 to the completed fluids package 34, for easier understanding of the description, reference has been made to only one paper tube and one package but it will be understood that from the web distributing station 25 onwards, always three paper tubes 9 will be machined simultaneously and finally removed also in the direction of the straight strand 38 of the removal conveyor 39.

Figure 2:
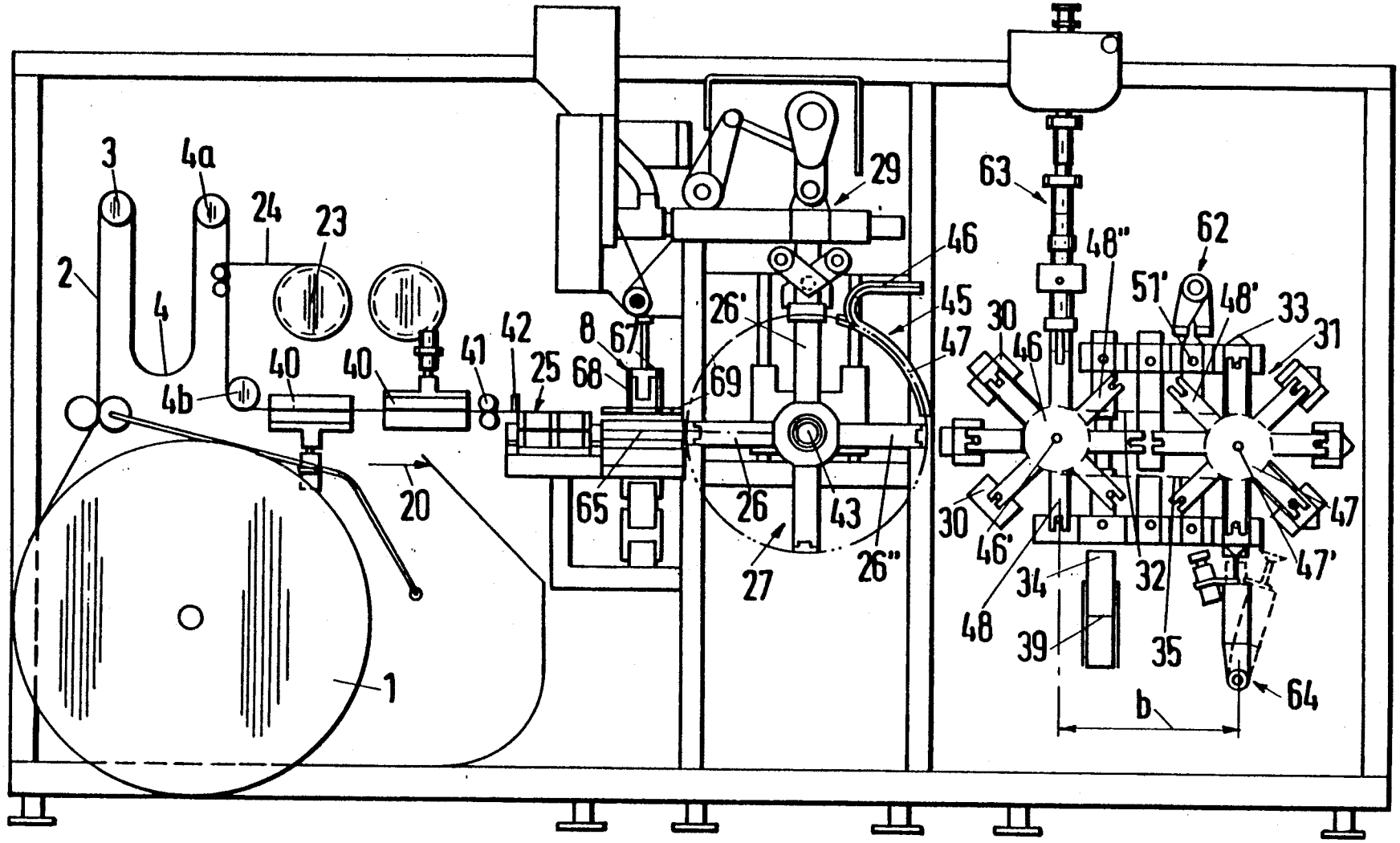
FIG. 2 is a side view of the manufacturing apparatus, showing on the left the web and also a singled-out flat blank, the paper tube or the finished package being however only shown at isolated locations on the apparatus.

FIG. 2 describes in greater detail the parts of the apparatus which handle the paper web 2. In the direction of movement 20, behind the bottom direction reversing roller 4*b*, there is a first embossing station and at a distance behind that a second embossing station 40, so that the embossed lines shown in the areas 21 and 22 in FIG. 1 can be made on the blank. Further in a direction of travel behind the embossing station 40, there is shown a pair of driving rollers 41 which pull the paper web 2 forwards from the supply roll 1 or out of the buffer loop 4 in the direction of movement 20, in fact pushing the cutter 42 into the web distributing station 25.

From the station 25, the blanks are passed by conveyors, not shown, to the folding device 8 which will be described hereinafter, the blanks leaving them in the form of a paper tube 9 which can be pushed onto the mandrel 26 of a mandrel wheel 27.

Three mandrel wheels are disposed on a common axis 43 so that they can rotate in the direction of the curved arrow 28 (FIG. 1) and so that they are axially separated by a gap (a) and are in each case provided with four radial mandrels 26 which are offset by 90° from one another, this angle being measured at their circumference. The above-mentioned first mandrel 26 is in a horizontal position to receive the paper tube 9 which has just been produced. More generally speaking, it is disposed in the handling plane and in the direction of travel 20. The paper tube 9 is open in front and at the back, and in the direction of travel 20 "back" means the upper end 44 which, upon movement of the mandrel wheel 27 and according to the direction of rotation 28 and after a rotation through 90°, is actually directed vertically upwardly. This top end 44 of the paper tube 9 is now under the injection station 29, which will not be described in greater detail here. Injection stations are already available with which, in the upper position of the mandrel 26', the lid 10 can be injection moulded onto the top end 44 of the paper tube 9.

Intermittently, the mandrel wheel 27 rotates about the axis 43 through 90° and onwards in the direction of rotation 28 so that the mandrel has now reached the right-hand horizontal position 26'' in FIG. 2, in which the lid 10 is directly opposite the endless conveyor 31 which is disposed close to and behind it in the direction of travel 20.

On the quarter-circular path between the mandrel position 26' and 26'' there is a cooling device 45 comprising feed tubes 46 for cooling air and an air outlet space 47 which has the form of a quarter-cylindrical jacket. At one end, this outflow space 47 is connected to the feed tube 46 and there are directed at the axis 43 of the mandrel wheel 27, numerous jets disposed on the inner surface of the space 47 so that the freshly injected lid 10, as the mandrel passes over the conveyor path from the position 26' to the position 26'', constantly exposed to a stream of cooling air. Therefore, when the mandrel has reached the position 26'', the lid 10 has sufficiently cooled and hardened.

The endless conveyor 31 which, in the direction of travel 20, is to the rear of and adjacent to the mandrel wheel 27, comprises an endless chain which forms the upper strand 32 at the top and the lower strand 35 at the bottom and it comprises a driving wheel 46 and a direction reversing wheel 47, the axes 46' and 47' of which are at a distance b in the direction of travel 20 in the handling plane and parallel with the axle 43 of the mandrel wheels 47.

Furthermore, both the driving wheel 46 and also the direction reversing wheel 47 of the endless conveyor 31 comprise entraining arms 48 which are identically constructed for all the wheels of the endless conveyor 31. Furthermore, it will be understood that the axles 46' and 47' of the wheels 46 and 47 are the same length as the axle 43 of the mandrel wheels and that both in front of and also behind the three parallel handling paths (viewed in the direction of the axes 43, 46', 47'), there are chins with an upper strand 32 and a lower strand 35 which are connected by transversely extending (parallel with the axles 34, etc.) conveyor parts. In the present case, on the endless conveyor 31 upstream and downstream of the three handling stations there are drive wheels 46 and direction reversing wheels 47 supported on the one hand via bearings on the relevant axles 46' and 47' and which carry the aforementioned entraining arms, in the ends of which are let grooves 50 (FIG. 6) by which elongately constructed plate-like receiving containers 30 are in turn supported at a distance and over the total width of the endless conveyor 31.

Receiving Containers

With reference to FIGS. 2 and 4 to 6, the construction of the receiving containers 30 and their mounting and movement in the endless conveyor 31 will be described as they relate to the drive arms 48. Each drive wheel 46 or direction reversing wheel 47 comprises six radially outwardly projecting entraining arms 48 spaced apart from the next at equal angles, the entraining arms 48 carrying at their outer ends the aforesaid slot 50. Over the total width of the endless conveyor 31 in the direction of the axes 46' or 47' there extend plate-like receiving containers 30 which also have an elongated strip shape. In the direction of the width of the endless conveyor 31 which lies in the direction of the axles 46' and 47', there extend journals 51 with rollers 52 which rotate about the latter. The journals 51 with the rollers 52 are disposed on the two broad sides of the receiving container 30 and can therefore be fitted into or separated from the two entraining arms of the two drive wheels 46 or into the entraining arms 48 of the two direction reversing wheels 47.

FIG. 4 shows in a broke away view the bearing in the slot 50 of the front entraining arm 48 when looking downwards in FIG. 6, in the direction of the arrows IV—IV.

Another view is FIG. 5 which shows the view along the line V—V in FIG. 4. The receiving container 30 which is broken away at the top, at 53, has in keeping with the three handling paths of the four tubes 9, three recesses 54 with, at the top, ramps 55, of which only one recess 54 is shown, namely that which is closest to the journal 51. The axis of this hole-like or cylindrically shaped recess 54 extends vertically according to FIG. 2 if the position of the receiving containers 30 is considered, particularly in the region of the upper strand 32 (naturally, in the case of the bottom strand 35, all this is reversed). One each recess 54 on the receiving container 10 there is an adjustable bottom support 56 in the form of an L-shaped rod. This is fitted laterally eccentrically on the recess 54 or outside it, in the receiving container 30. This bottom support 56 is of rod form and projects away upwardly out of the receiving container and to a much greater extend downwardly in the direction of the upper 32 or lower 35 stand, the rod 56 carrying an end stop 57 at its bottom end. This is the aforesaid arm of the L, which is why the bottom support 56 can be conceived as being generally L-shaped and comprising the rod 56 and the abutment 57. It will be understood that when pushing in a paper tube 9 according to FIG. 4 into the recess 54 from above and in a downwards direction or according to FIG. 5 from right to left, the tube 9 is passed through the thickness (c) of the receiving container 30 until, as it is pushed downwards, it encounters the abutment 57, the abutment 57 determining the depth to which the tube 9 can be pushed in. The paper tube is now seated with a clamping effect in this receiving container 30 and can follow the movement of this latter.

The movements for the receiving container are controlled by the rollers 52 on the journals 51 and these are in turn controlled by the movement of the entraining arms 48, which of course rotate about the axes 46' and 47'. Therefore, each point on the groove 50 on the entraining arm 48 passes through an arc of a circle.

It can be seen from FIG. 6 that the right-hand arm 58 is alongside the groove 50 and in a radial direction of the entraining arm 48 shorter than the left arm 59 which carries a gently rounded curve 60 on the outside, along which the rollers 46 can run on and off. All the entraining arms 48 are constructed in this way, the shorter arm 58 alongside the groove 50 being towards the front in the direction of rotation as indicated by the arrow 61, the curve 60 being behind the groove 50.

If one examines this construction in combination with the endless conveyor 31 in FIG. 2, then it can be seen that the curve 60 indicates and determines the final position of the relevant receiving container 30. The front arm 58 of the entraining arm 48 along the groove 50 is shorter than the rear arm 59 so that the radially outer end of the shorter entraining arm 58 during running in, as is shown for example just previously in the position 48' in FIG. 2, so this front arm 58 can pass by the journal 51' (FIG. 2). Conversely, during outwards running of the entraining arm according to the position 48'' in FIG. 2, the cam 60 gives a final push to the journal 51 of the receiving container 30 so that the row of mutually contacting adjacently disposed four receiving containers 30 assume the correct position on the upper strand.

This correct position is of importance for the sealing station generally designated 62, in which the abovementioned transverse sealing seam 33 is made. Hitherto, the package in the filling station generally designated 63 was filled by a raising and slow filling, after which it passed through two pause positions before it reached the position under the sealing station 62.

Once the filled package provided with the transverse seal 33 has been pivoted about the direction reversing wheel 47 in a clockwise direction according to FIG. 2, sealing of the triangular lugs 36 on the flat surface of the fluids package 34 takes place in the sealing station generally designated 64, the flowing medium assisting cooling in the region of the sealing station 64. Once the now completed fluids package 34 has passed through in the direction 37 (from right to left in FIG. 2), the package then reaches the delivery position 16 from which it is pushed down vertically onto the removal conveyor 39 and is then removed.

Folding Device

FIGS. 3 and 3*a* show the folding device illustrated in FIG. 2 on the left of the mandrel wheel 27. Looking in the direction 20 of movement of the relevant blank 7, one sees the view of FIG. 3 with the blank 7 and the cover strip 24 of synthetic plastics material as an edge protector, flat with the blank 7 and under it the bracing mandrel 65. In the present example of embodiment, the cross-section of the bracing mandrel 65 in FIG. 3 is square with rounded corners. In other embodiments, according to the shape of tube desired, so the outer surface of the bracing mandrel may also be cylindrical or the like. The bracing mandrel is supported on the machine frame by a carrier 66 consisting of flat material, as shown in FIG. 3*a*, namely it is supported on the sight line III—III in FIG. 3. Above the bracing mandrel 65 is the bearing 67 for two arms 68 each with rollers 69 mounted at their bottom outer ends. The rollers are made as long as the bracing mandrel 65 so that upon a downwards movement in the direction of the arrow 69*b*, they are able to roll over virtually the entire outer surface of the bracing mandrel 65. When, after completing the downwards movement according to the arrow 69, the rollers 69 have almost reached their extreme position, they are in the position designated 69' under the bracing mandrel 65 as shown in broken lines. Then also the ends of the blank 7 will overlap to form a longitudinal sealing seam, by means of the welding die 70 which is adapted for outwards and downwards movement in the direction of the double-headed arrow 71. The two arms 68 are coupled to each other by a spring 72 which draws them together (traction spring). This guarantees that even during the downwards movement of the arms 68 with the rollers 69, these latter remain in contact with the surfaces of the bracing mandrel 65.

We claim:

1. An apparatus for producing a fluid containing package from a synthetic plastics coated paper tube, one end of said tube being at least partially closed by injection molded parts of synthetic plastics material, the other end of said tube being closed by folding and welding of the tube material, comprising means for forming a tube from a web of synthetic plastics coated paper, said forming means including means for supplying said coated paper web, means for converting said web supply into a plurality of tube blanks, means for distributing said tube blanks to a plurality of folding means, each of said folding means adapted to form a tube from said tube blanks; a plurality of mandrel wheels mounted for rotation about a common axis, each mandrel wheel comprising a plurality of radially extending mandrels, each mandrel being adapted to receive a tube from said folding means, injection station means adapted to close one end of a tube received upon a mandrel and rotated to the position of said injection station means with synthetic plastics material, a plurality of endless conveyer means adapted to receive the closed end of a tube from a mandrel upon sufficient rotation of a mandrel wheel, and said endless conveyer means being further adapted to advance said tube to a filling station, a transverse sealing station, a folding and welding station, thereby completing the fluid containing package, and to further advance said fluid containing package to removal conveyer means.

2. An apparatus for producing a fluids package of quadrangular cross-section with a synthetic plastics coated paper tube (9), of which one end is at least partially closed by injection moulded parts (10) of synthetic plastics material, the other end being closed by folding and welding the tube material, comprising means (8) for forming a tube (9) from a web (2) by means of an intermittently operating welding die (70), at least one intermittently rotatable mandrel wheel (27), an injection station (29), an endless conveyor (31) for the packages (34) during their manufacture, a filling station (63), a closing station (62) and a removal conveyor (39), wherein the direction of movement (20, 20') of a paper web (2) extends perpendicularly to the axis of a single paper web supply roll (1), at least two mandrel wheels (27) disposed to rotate beside each other about a common axis (43), in front of which, viewed against the direction of movement (20,20') of the relevant paper tube (9), there are a folding device (8) and, in front of that, a web distributing station (25) and behind which (27) there is a two-track endless conveyor (31) the two tracks of which extend in two different planes, one located below the other, and which conveyor (31) comprises containers (30) adapted to receive the packages (34) which run along on the bottom strand (35), the said containers (30) being adapted to be moved into position (11) disposed in a rectilinear extension of the relevant package path (20), and that the path of the relevant paper tube (9), upon transfer from one station (25, 8, 27) of the apparatus to the next lies in a horizontal straight line from the folding device (8) as far as the receiving position (11) off the endless conveyor (31).

3. An apparatus according to claim 1, wherein the longitudinal direction of the receiving container (30) which lies horizontally in the receiving position (11) lies vertically in the delivery position (16).

4. An apparatus according to claim 1, wherein the filling station (63) and the closing station (62) are, in the region of the endless conveyor (31), disposed alongside and in functional communication with this latter.

5. An apparatus according to claim 1, wherein the removal means (38) of the removal conveyor (39) is parallel with the common axis (43) of the mandrel wheels (27), at least in the region of the endless conveyor (31).

6. An apparatus according to claim 1, wherein the folding device (8) has rollers (69) mounted on movably driven arms (68), a bracing mandrel (65) and a movable welding die (70) which are disposed beside one another and which are disposed to be brought into engagement with one another (FIG. 3, 3*a*).

7. An apparatus according to one of claim 1, wherein in the endless conveyor (31) there is at least one row of receiving containers (30) comprising at least one recess (54) for a package (34) and revolving in the form of an endless chain, the containers (30) being supported to be driven in the straight strand (32, 35) in such a way that they touch one another and in that in a rectilinear extension of the package path (2, 20) there are driving wheels (46) and/or direction reversing wheels (47) disposed one after another at intervals (b).

8. An apparatus according to claim 7, wherein each driving (46) and direction reversing (47) wheel comprises radial arms (48) with, disposed at the outer ends, slots (50) for separable engagement with journals (51) on the receiving containers (30).

9. An apparatus according to claim 8, wherein an adjustable bottom support (56) is disposed on each recess (54) in the receiving container (30) (FIGS. 4 and 5).

10. An apparatus according to claim 1 or claim 3, wherein a cooling device (45) is provided between the injection station (29) and the endless conveyor (31) on the conveyor path (26' to 26'') of the lid (10) which is integrally moulded onto the paper tube (9)

* * * * *

UNITED STATES PATENT AND TRADEMARK OFFICE

CERTIFICATE OF CORRECTION

PATENT NO. : 5,069,021

DATED : December 3, 1991

INVENTOR(S) : Wilhelm Reil, et al

It is certified that error appears in the above-identified patent and that said Letters Patent is hereby corrected as shown below:

Col. 8, line 37, after the words "and filled" insert the word -- fluids --.

Col. 10, line 3, delete "chins" and substitute -- chains --.

Col. 10, line 12, delete "elongately" and substitute -- elongatedly --.

Col. 14, line 7, after the words "claim 1" insert the words -- and 2 --.

Signed and Sealed this

Tenth Day of August, 1993

*Attest:*

Michael K. Kirk

MICHAEL K. KIRK

*Attesting Officer*

*Acting Commissioner of Patents and Trademarks*